US009491804B2

(12) United States Patent
Okamura

(10) Patent No.: US 9,491,804 B2
(45) Date of Patent: Nov. 8, 2016

(54) HEATER AND GLOW PLUG INCLUDING THE SAME

(71) Applicant: KYOCERA Corporation, Kyoto-shi, Kyoto (JP)

(72) Inventor: Takeshi Okamura, Aira (JP)

(73) Assignee: Kyocera Corporation, Kyoto (JP)

( * ) Notice: Subject to any disclaimer, the term of this patent is extended or adjusted under 35 U.S.C. 154(b) by 235 days.

(21) Appl. No.: 14/347,163

(22) PCT Filed: Sep. 29, 2012

(86) PCT No.: PCT/JP2012/075269
§ 371 (c)(1),
(2) Date: Mar. 25, 2014

(87) PCT Pub. No.: WO2013/047849
PCT Pub. Date: Apr. 4, 2013

(65) Prior Publication Data

US 2014/0246417 A1 Sep. 4, 2014

(30) Foreign Application Priority Data

Sep. 29, 2011 (JP) ..... 2011-214807

(51) Int. Cl.

| | |
|---|---|
| ***F23Q 7/22*** | (2006.01) |
| ***H05B 3/12*** | (2006.01) |
| ***H05B 3/14*** | (2006.01) |
| ***H05B 3/48*** | (2006.01) |
| ***H05B 3/18*** | (2006.01) |
| ***F23Q 7/00*** | (2006.01) |

(52) U.S. Cl.
CPC *H05B 3/12* (2013.01); *F23Q 7/00* (2013.01); *H05B 3/141* (2013.01); *H05B 3/18* (2013.01); *H05B 3/48* (2013.01); *H05B 2203/027* (2013.01)

(58) Field of Classification Search
CPC ..... H05B 3/12; H05B 3/18; H05B 3/141; H05B 3/48; H05B 2203/027; F23Q 7/00
See application file for complete search history.

(56) References Cited

U.S. PATENT DOCUMENTS

| | | | |
|---|---|---|---|
| 5,877,474 | A | 3/1999 | Konishi |
| 6,084,220 | A | 7/2000 | Suematsu et al. |
| 2002/0162830 | A1 | 11/2002 | Taniguchi et al. |
| 2005/0274707 | A1 | 12/2005 | Matsubara et al. |

FOREIGN PATENT DOCUMENTS

| | | | |
|---|---|---|---|
| CN | 1180982 | A | 5/1998 |
| EP | 1120998 | * | 8/2001 |

(Continued)

OTHER PUBLICATIONS

Extended European Search Report, 12835329.9, May 8, 2015, 5 pgs.

(Continued)

*Primary Examiner* — Shawntina Fuqua
(74) *Attorney, Agent, or Firm* — Volpe and Koenig, P.C.

(57) ABSTRACT

The present invention provides a heater including an insulating base made of ceramic, and an electrically conductive line embedded in the insulating base. The electrically conductive line contains electrically conductive grains and ceramic grains. The average grain size of the ceramic grains in the electrically conductive line is smaller than the average grain size of the ceramic grains in the insulating base.

4 Claims, 2 Drawing Sheets

(56) References Cited

FOREIGN PATENT DOCUMENTS

| | | | | |
|---|---|---|---|---|
| EP | 1120998 | A1 | | 8/2001 |
| EP | 1501335 | | * | 1/2005 |
| EP | 1501335 | A1 | | 1/2005 |
| JP | H0864346 | A | | 3/1996 |
| JP | 10-32079 | A | | 2/1998 |
| JP | 11-135239 | A | | 5/1999 |
| JP | 2002-334768 | A | | 11/2002 |
| JP | 3691649 | B2 | | 9/2005 |
| JP | 2007-141740 | A | | 6/2007 |
| JP | 2009-287920 | A | | 12/2009 |
| WO | 2003-092330 | A1 | | 11/2003 |

OTHER PUBLICATIONS

International Search Report, PCT/JP2012/075269, Nov. 13, 2012, 2 pgs.

Chinese Office Action with English concise explanation, Chinese Patent Application No. 201280047870.3, Feb. 27, 2015, 8 pgs.

Korean Office Action with English concise explanation, Korean Patent Application No. 10-2014-7007935, Apr. 30, 2015, 4 pgs.

* cited by examiner

HEATER AND GLOW PLUG INCLUDING THE SAME

FIELD OF INVENTION

The present invention relates to a heater used as, for example, an ignition or flame detection heater for in-vehicle heating apparatuses, an ignition heater for burning appliances including an oil fan heater, a glow plug heater of an automobile engine, a heater for sensors including an oxygen sensor, or a heater for heating measuring instruments, and to a glow plug including the same.

BACKGROUND

A heater used in, for example, a glow plug of an automobile engine includes an insulating base and an electrically conductive line embedded in the insulating base. The electrically conductive line includes a resistor including a heat-generating portion and a lead led out at the surface of the insulating base. The lead is designed or the material of the lead is selected so that the lead has a lower resistance than the resistor (see, for example, PTL 1).

CITATION LIST

Patent Literature

[PTL 1] Japanese Unexamined Patent Application Publication No. 2002-334768

SUMMARY

Technical Problem

In recent years, a higher electric power has become increasingly rushed into a heater more suddenly, and accordingly the following rapid temperature changes occur in the heater in a transient state until the temperature of the heater stabilizes.

The resistor at the tip of an electrically conductive line starts generating heat first. Then, the heat propagates through the surface portion of the electrically conductive line from the resistor to the end of the lead, thus heating the electrically conductive line from the surface portion thereof. Then, the insulating base having a lower thermal conductivity than the electrically conductive line is heated by the heat conducted through the electrically conductive line. At this time, since the insulating base having a lower thermal conductivity than the electrically conductive line is heated later, the thermal expansion in the axis direction differs between the electrically conductive line and the insulating base in such a manner that while the firstly heated electrically conductive line is straightly expanding in the axis direction, then the later-heated insulating base expands. Consequently, a stress is placed on the interface between the electrically conductive line and the insulating base.

If the heater continues heating with a stress placed on the interface, micro-cracks or the like are likely to occur in the surface portion of the electrically conductive line, thus undesirably causing resistance changes.

The present invention is proposed in view of the above issue, and an object of the invention is to provide a heater in which micro-cracks or the like are unlikely to occur even if a large current flows in the electrically conductive line, and to provide a glow plug including the heater.

Solution to Problem

A heater of the present invention includes an insulating base made of ceramic, and an electrically conductive line embedded in the insulating base. The electrically conductive line contains electrically conductive grains and ceramic grains. The ceramic grains in the electrically conductive line have smaller average grain size than the ceramic grains in the insulating base.

Furthermore, the present invention provides a glow plug including a heater having the above-described structure, and a metallic holding member electrically connected to the electrically conductive line and holding the heater.

Advantageous Effects of Invention

In the heater of the present invention, since the electrically conductive line contains electrically conductive grains and ceramic grains, the thermal expansion coefficient of the electrically conductive line can be brought close to the thermal expansion coefficient of the insulating base, and thus the stress placed on their interface can be reduced. In addition, since the ceramic grains in the electrically conductive line has a smaller average grain size than the ceramic grains in the insulating base, the ceramic grains in the electrically conductive line do not easily become larger than those in the insulating base even though the ceramic grains in the electrically conductive line, which is heated prior to the insulating base, start thermal expansion immediately after power inrush. Accordingly, the stress placed on the ceramic grains in the insulating base around the electrically conductive line becomes larger than the stress placed between the electrically conductive grains and the ceramic grains in the surface portion of the electrically conductive line. Consequently, the micro-cracks are unlikely to occur between the ceramic grains and the electrically conductive grains in the surface portion of the electrically conductive line, and the resistance does not vary easily. Thus, the reliability and durability of the heater is enhanced.

DETAILED DESCRIPTION OF THE PREFERRED EMBODIMENTS

An embodiment of the heater of the present invention will now be described in detail with reference to the drawings.

Figure 1:
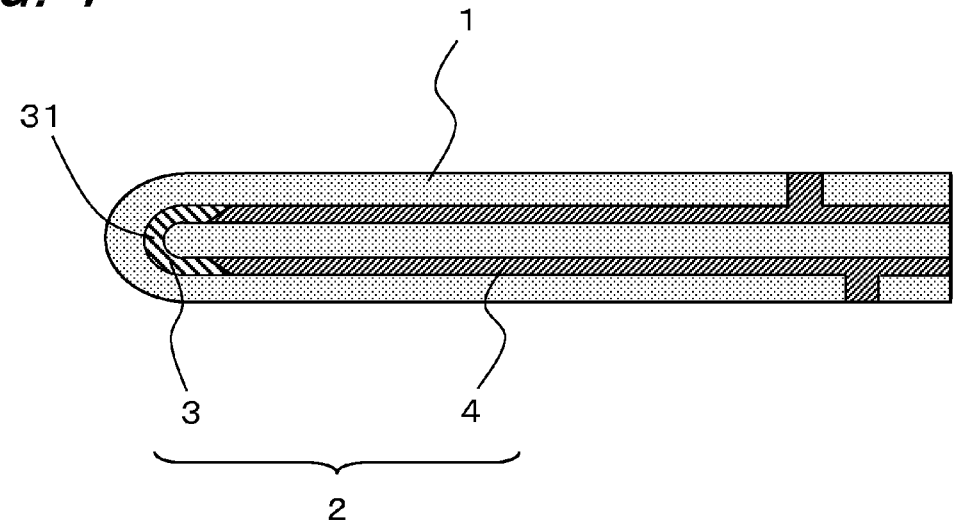
FIG. 1 is a longitudinal sectional view of an embodiment of the heater of the present invention.

FIG. 1 is a longitudinal sectional view of an embodiment of the heater of the present invention.

The heater of the present embodiment includes an insulating base 1 made of ceramic, and an electrically conductive line 2 embedded in the insulating base 1. The electrically conductive line 2 contains electrically conductive grains and ceramic grains. The ceramic grains in the electrically conductive line 2 have a smaller average grain size than the ceramic grains in the insulating base 1.

The insulating base 1 of the heater of the present embodiment has been formed in, for example, a rod-like shape. The insulating base 1 covers the electrically conductive line 2. In other words, the electrically conductive line 2 is embedded in the insulating base 1. Preferably, the insulating base 1 is made of ceramic. Since ceramics is more resistant to high temperature than metals, the heater can exhibit good reliability while heating rapidly. More specifically, examples of the ceramic include oxide ceramics, nitride ceramics, carbide ceramics, and other electrically insulating ceramics. Preferably, the insulating base 1 is made of a silicon nitride-based ceramic. This is because silicon nitride, which is the main constituent of silicon nitride-based ceramics, is superior in strength, toughness, insulation, and heat resistance. For forming a silicon nitride-based ceramic, for example, 3% to 12% by mass of a rare-earth metal oxide as a sintering agent, such as $Y_2O_3$, $Yb_2O_3$, or $Er_2O_3$, 0.5% to 3% by mass of $Al_2O_3$, and $SiO_2$ are mixed with the main constituent silicon nitride relative to the mass of the silicon nitride. The amount of $SiO_2$ added is such that the $SiO_2$ content in the sintered compact can be 1.5% to 5% by mass. The mixture is formed into a predetermined shape and then subjected to hot plate sintering at 1650 to 1780° C.

If the insulating base 1 is made of a silicon nitride-based ceramic, it is preferable to add $MoSi_2$, $WSi_2$, or the like and disperse it in the ceramic. These materials can bring the thermal expansion coefficient of the base matrix or silicon nitride-based ceramic close to the thermal expansion coefficient of the electrically conductive line 2, thereby enhancing the durability of the heater.

The electrically conductive line 2 includes a resistor 3, for example, in a turn-back shape, and a pair of leads 4 joined to the ends of the resistor 3 at the tip of the heater and led out to the surfaces of the insulating base 1.

The resistor 3 has a heat-generating portion 31 at which heat is particularly generated. The heat-generating portion 31 may be defined by forming a region having a small sectional area or a helical region. If the resistor 3 has a turn-back shape as shown in FIG. 1, the midpoint of the turn-back and its vicinity act as a heat-generating portion 31 at which heat is most generated.

The resistor 3 may be made of a metal such as W, Mo, or Ti, or a material mainly containing a carbide, a nitride or a silicide. If the insulating base 1 is made of the above-described material, tungsten carbide (WC) is most suitable of those materials as the material of the resistor 3 because it has a small difference in thermal expansion coefficient from the insulating base 1, and has a high heat resistance and a low specific resistance. If the insulating base 1 is made of a silicon nitride-based ceramic, it is more preferable that the resistor 3 contain mainly WC, which is an inorganic electrically conductive material, and, in addition, 20% by mass or more of silicon nitride. The resistor 3 in the insulating base 1 of, for example, a silicon nitride-based ceramic is normally in a state where a stress is placed thereon because the electrically conductive material of the resistor 3 has a larger thermal expansion coefficient than silicon nitride. However, the thermal expansion coefficient of the resistor 3 can be brought close to the thermal expansion coefficient of the insulating base 1 by adding silicon nitride to the resistor 3, and thus, the stress can be reduced which results from the difference in thermal expansion coefficient produced during the heating or cooling of the heater.

Also, if the silicon nitride content in the resistor 3 is 40% by mass or less, the resistance of the resistor 3 can be relatively low and stable. The silicon nitride content in the resistor 3 is preferably 20% by mass to 40% by mass. More preferably, the silicon nitride content is 25% by mass to 35% by mass. As an alternative to silicon nitride, 4% by mass to 12% by mass of boron nitride may be added as a similar additive to the resistor 3.

The resistor 3 preferably has a thickness of, for example, 0.5 mm to 1.5 mm and a width of, for example, 0.3 mm to 1.3 mm. The resistor 3 having dimensions in these ranges can efficiently generate heat even if the resistance thereof is reduced, and allows the multilayer insulating base 1 to maintain the adhesion between the layers.

The leads 4 joined to the ends of the resistor 3 at the tip of the heater may be made of the same material as the resistor 3, which mainly contains a metal such as W, Mo, or Ti, or a carbide, a nitride, a silicide, or the like. In particular, WC is suitable as the material of the leads 4 because WC has a small difference in thermal expansion coefficient from the insulating base 1, and has a high heat resistance and a low specific resistance. If the insulating base 1 is made of a silicon nitride-based ceramic, it is preferable that the leads 4 mainly contain an inorganic electrically conductive material WC, and further contain silicon nitride with a content of 15% by mass or more. As the silicon nitride content is increased, the thermal expansion coefficient of the leads 4 comes closer to the thermal expansion coefficient of the insulating base 1. Also, the leads 4 containing silicon nitride with a content of 40% by mass or less has a stable, low resistance. The silicon nitride content is preferably 15% by mass to 40% by mass. More preferably, the silicon nitride content is 20% by mass to 35% by mass. The resistance per unit length of the leads 4 may be set to be lower than that of the resistor 3 by controlling the content of the insulating base 1 material in the leads to be lower than that in the resistor 3, or by controlling the sectional area of the leads to be larger than that of the resistor 3.

The electrically conductive line 2 contains electrically conductive grains and ceramic grains, and the average grain size of the ceramic grains in the electrically conductive line 2 is lower than the average grain size of the ceramic grains in the insulating base 1.

In this instance, the average grain size of the ceramic grains in the electrically conductive line 2 is in the range of 10% to 80%, preferably in the range of 30% to 60%, of the average grain size of the ceramic grains in the insulating base 1. When it is 10% or more, it can be reduced that cracks occur in the smaller ceramic grains by receiving a stress in a region where the ceramic grains in the electrically conductive line 2 come into direct contact with the ceramic grains in the insulating base 1. When it is 80% or less, the entry of high frequency to the electrically conductive line 2 can be suppressed as will be described later.

The average grain size of the ceramic grains can be measured as below. The heater is cut at an arbitrary position where the electrically conductive line 2 is embedded, and the section is observed through a scanning electron microscope (SEM) or a metallurgical microscope. Arbitrary 5 lines are drawn in the obtained observation image, and the average grain size is determined from the average of the lengths defined by 50 grains across the line. As an alternative to such a chord method, an image analyzer LUZEX-FS manufactured by Nireco may be used to determine the average grain size.

Since the electrically conductive line 2 contains electrically conductive grains and ceramic grains, the above-described condition enables the thermal expansion coefficient of the electrically conductive line 2 to come close to that of the insulating base 1, and thus can reduce the force placed on the interface.

In addition, the following disadvantage can be eliminated. More specifically, the heater continues heating even in a state where a stress is placed on the interface. Accordingly, the ceramic grains in the electrically conductive line 2 start thermal expansion as the electrically conductive grains around the ceramic grains are heated, and the ceramic grains in the surface portion of the previously heated electrically conductive line 2 become larger than the ceramic grains in the other region. Thus, the stress placed on the interface between the electrically conductive line 2 and the insulating base 1 is concentrated between the ceramic grains and the electrically conductive grains in the surface portion of the electrically conductive line 2, thereby causing micro-cracks between the ceramic grains and electrically conductive grains and causing the resistance to vary.

On the other hand, in the present invention, since the ceramic grains in the electrically conductive line 2 has a smaller average grain size than the ceramic grains in the insulating base 1, the ceramic grains in the electrically conductive line 2 do not easily become larger than those in the insulating base 1 even though the ceramic grains in the electrically conductive line 2, which is heated prior to the insulating base 1, start thermal expansion immediately after power inrush. Accordingly, the stress placed on the ceramic grains in the insulating base 1 around the electrically conductive line 2 becomes larger than the stress placed between the electrically conductive grains and the ceramic grains in the surface portion of the electrically conductive line 2. Consequently, micro-cracks are unlikely to occur between the ceramic grains and the electrically conductive grains in the surface portion of the electrically conductive line 2, and the resistance does not easily vary. In addition, since the insulating base 1 made of a sintered compact of ceramic grains has a higher strength the electrically conductive line 2, micro-cracks does not occur easily in the ceramic grains around the electrically conductive line 2.

Furthermore, the following disadvantage can be eliminated. In order to optimize the combustion of an engine, a method in which control signals from ECU are pulsed is increasingly being taken for operating the heater. Pulsed signals are often in the form of rectangular waves. The leading edge of the pulses contains a high frequency component, and the high frequency component has the feature of being transmitted through the surface portion of the electrically conductive line embedded in the heater. However, if the ceramic grains in the electrically conductive line have a grain size larger than or equal to the grain size of the ceramic grains in the insulating base, the high frequency component is transmitted not only through the surface portion of the electrically conductive line, but also to the inside of the electrically conductive line. The boundaries between the ceramic grains and the electrically conductive grains are used as if they were the surface of the electrically conductive line. Consequently, transmission loss is increased, and the regions between ceramic grains and electrically conductive grains in the surface portion of the electrically conductive line, to which the high frequency component is likely to stray, are heated to cause micro-cracks along the boundaries between the ceramic grains and the electrically conductive grains. Consequently, the resistance is undesirably varied.

On the other hand, in the case of the present invention described above, even if rectangular waves are used for pulse operation, the high frequency component in the leading edge of the pulses is transmitted only through the surface portion of the electrically conductive line 2 without using the boundaries between the ceramic grains and electrically conductive grains in the electrically conductive line 2 as if they were the surface portion of the electrically conductive line 2. Particularly when the grain size of the ceramic grains in the electrically conductive line 2 is 80% or less of the grain size of the ceramic grains in the insulating base 1, the high frequency component does not stray into the electrically conductive line 2. Consequently, it can be suppressed to heat the boundaries between the ceramic grains and the electrically conductive grains in the surface portion of the electrically conductive line 2 and to form micro-cracks along the boundaries between the ceramic grains and the electrically conductive grains, and thus the resistance dose not vary easily.

Therefore, even when the leading edge of electric power inrush is sharp, micro-cracks do not occur easily between the ceramic grains and electrically conductive grains in the surface portion of the electrically conductive line 2 irrespective of whether the heater is operated by pulses or DC, and the resistance can be stable for a long time accordingly. Thus, the reliability and durability of the heater is enhanced.

As for the ceramic grains in the electrically conductive line 2, preferably, the average grain size thereof in the inner side of the surface portion is smaller than that in the surface portion close to the interface with the insulating base 1. In this condition, even though a force is placed on the interface between the electrically conductive line 2 and the insulating base 1 immediately after power inrush, the stress can be dispersed in a short time in all directions outside the grains with lattice vibration and thus dispersed toward the center in cross section of the electrically conductive line 2 because stress propagation time is shorter for propagation through small grains in both surface area and volume than for propagation through larger grains. Consequently, micro-cracks become more difficult to form between the ceramic grains and the electrically conductive grains in the surface portion of the electrically conductive line 2, and the resistance is more unlikely to vary accordingly. If the electrically conductive line 2 has a circular cross section, the diameter of the electrically conductive line 2 is, for example, 10 μm to 2 mm, and the surface portion has, for example, a thickness of 1 μm to 100 μm, that is, a depth, from the surface, of 0.5 to 10% of the diameter.

It is effective that the average grain size of the ceramic crystal grains in the electrically conductive line 2 is 0.2 to 10 μm in the surface portion close to the interface with the insulating base 1 and is reduced to 70% to 80% in the inner side of the surface portion.

Also, it is preferable that the average grain size of the ceramic grains in the electrically conductive line 2 be smaller than the average grain size of the electrically conductive grains in the electrically conductive line 2. In this condition, even though a force is placed on the interface between the electrically conductive line 2 and the insulating base 1 immediately after power inrush, the stress is propagated among the electrically conductive grains in the electrically conductive line 2 without being propagated between the ceramic grains and electrically conductive grains in the surface portion of the electrically conductive line 2. Therefore micro-cracks do not occur and the resistance does not vary. This is because, for crystal lattice vibration, the electrically conductive grains more violently vibrate than ceramic grains, and accordingly stress can be propagated faster among electrically conductive grains.

Particularly when ceramic grains in the electrically conductive line 2 are dispersed to separate from each other, the surface of the electrically conductive line 2 is almost covered with the electrically conductive grains as long as the average grain size of the ceramic grains in the electrically conductive line 2 is 70% or less of the average grain size of the electrically conductive grains. Thus, high frequency does not stray into the inside particularly. Consequently, the surface portion of the electrically conductive line 2 is kept from being heated between the ceramic grains and the electrically conductive grains, and from forming micro-cracks along the boundaries between the ceramic grains and the electrically conductive grains, and the resistance is more unlikely to vary accordingly.

Preferably, the electrically conductive line 2 further contains Cr with a content of 1×10-6% by mass to 1×10-1% by mass in terms of oxide. This is because when the electrically conductive line 2 is locally heated to a temperature at which micro-cracks can occur, Cr is ionized to act as a sintering agent for the electrically conductive grains. In particular, the tips of cracks, to which heat tends to be concentrated, becomes easy to sinter because of the energy of cracks, and thus the extension of cracks is suppressed. If the Cr content is less than 1×10-6% by mass in terms of oxide, the electrically conductive material is hardly sintered at the tips of cracks. The Cr content is preferably 1×10-6% by mass or more. If the Cr content in terms of oxide exceeds 1×10-1% by mass, the ceramic in the electrically conductive line 2 is promoted to grow to grains having a grain size larger than or equal to the size of the ceramic grains in the insulating base 1 in the step of sintering the heater. Therefore the Cr content is preferably 1×10-1% by mass or less.

Particularly when the Cr content is in the range of 1×10-6% by mass to 1×10-2% by mass, the resulting heater can be stable because Cr ions do not start to immigrate to the cathode even after long time use.

Figure 2:
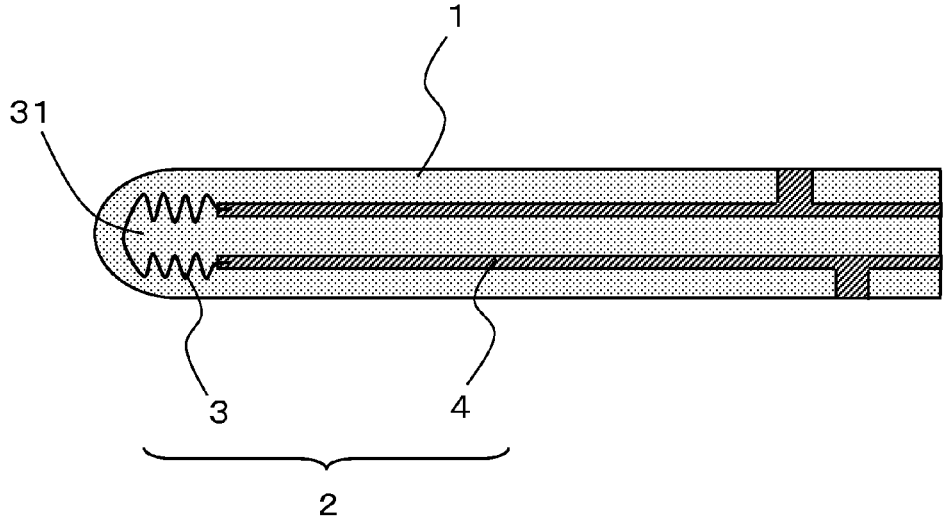
FIG. 2 is a longitudinal sectional view of another embodiment of the heater of the present invention.
Figure 3:
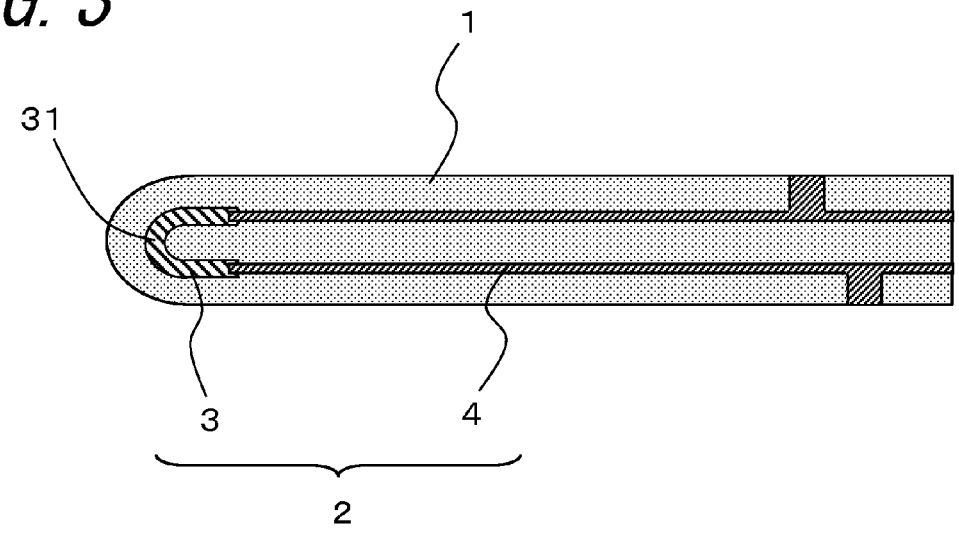
FIG. 3 is a longitudinal sectional view of still another embodiment of the heater of the present invention.

Even when the resistor 3 is made of a metal wire as shown in FIG. 2 or when part of the leads 4 are made of a metal wire as shown in FIG. 3, the same effects as described above are produced. However, if an external strong impact is applied while the heater is heating, a slip stress of the metal wire is placed on the interface between the metal wire and the insulating base 1, and shear stress is placed on the interface between the metal wire and the insulating base 1. Accordingly, when both the resistor 3 and the leads 4 of the electrically conductive line 2 as shown in FIG. 1 contain electrically conductive grains and ceramic grains, stress can be relieved most effectively.

The heater of the present embodiment is suitably used in a glow plug, which includes the heater in any of the above-described forms, and a metallic holding member electrically connected to the electrically conductive line 2 (leads 4) and holding the heater.

Figure 4:
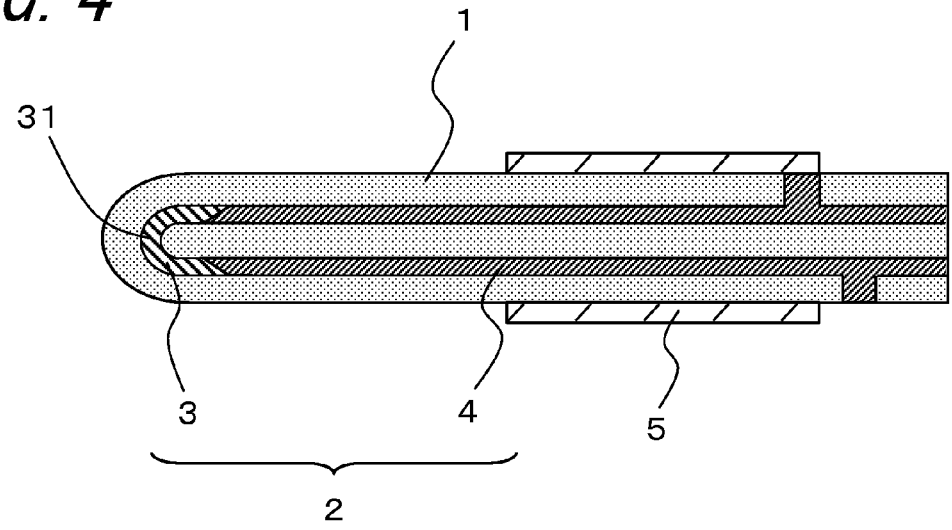
FIG. 4 is a longitudinal sectional view of an embodiment of the glow plug of the present invention.

More specifically, the heater is suitably used in a glow plug that includes a heater including a resistor 3 in a turn-back shape embedded in an insulating base 1 and a pair of leads 4 embedded and electrically connected to the respective ends of the resistor 3, a metallic holding member 5 (metallic sheath) electrically connected to one of the leads 4, and a wire electrically connected to the other lead 4, as shown in FIG. 4.

The metallic holding member 5 (metallic sheath), which is a metallic tube holding the heater therein, is joined with one of the leads 4 led out to the side surface of the insulating base 1 with solder or the like. The wire is joined with the other lead 4 with solder or the like. Since the resistance of the heater does not vary even if it is use for a long time with repetitive ON/OFF operation in a high-temperature engine, the glow plug can exhibit satisfactory ignition quality.

A process for manufacturing the heater of the present embodiment will now be described.

The heater of the present embodiment may be formed by, for example, injection molding using molds having a shape of the resistor 3 and leads 4 of the electrically conductive line 2 and a shape of the insulating base 1.

First, an electrically conductive paste for forming the resistor 3 and the leads 4, containing an electrically conductive ceramic powder and a resin binder is prepared, and also a ceramic paste for forming the insulating base 1, containing an insulating ceramic powder and a resin binder is prepared.

At this time, the particle size of the insulating ceramic powder added to the electrically conductive paste used for forming the resistor 3 and leads 4 of the electrically conductive line 2 is set smaller than that of the insulating ceramic powder added to the paste used for forming the insulating base 1.

If the particle size of the insulating ceramic powder added to the electrically conductive paste for forming the resistor 3 and leads 4 of the electrically conductive line 2 is the same as the particle size of the insulating ceramic powder added to the paste for forming the insulating base 1, a sintering agent is added which can help electrically conductive grains grow while hindering ceramic grains from growing in the electrically conductive line 2 in the step of sintering the electrically conductive line 2. For example, in the case of using Cr as the sintering agent, the Cr content is preferably 1×10-6% by mass to 1×10-1% by mass in terms of oxide.

In order to control the average grain size of the ceramic grains in the electrically conductive line 2 to be smaller in the inner side than in the surface portion close to the interface with the insulating base 1, the sintering start temperature of the insulating ceramic powder for forming the insulating base 1 may be controlled to be lower than that of the insulating ceramic powder for forming the electrically conductive line 2 so that the sintering of the insulating ceramic powder for the insulating base 1 is started prior to the sintering of the insulating ceramic powder for the electrically conductive line 2.

For this purpose, the amount of the sintering agent added to the insulating ceramic powder for the insulating base 1 may be increased relative to the amount of the sintering agent added to the insulating ceramic powder for the electrically conductive line 2, or, for example, Cr may be used as the sintering agent. Cr helps the electrically conductive grains grow while hindering ceramic grains from growing in the electrically conductive line 2 in the step of sintering the electrically conductive line 2.

Thus, the constituent of a liquid phase formed when the insulating ceramic powder for the insulating base 1 is sintered is dispersed into the electrically conductive line 2, and thus the insulating ceramic powder in the surface portion that has come in contact with the constituent of the liquid phase starts sintering even at a temperature at which the insulating ceramic powder in the inner side of the surface portion of the electrically conductive line 2 cannot sinter. Consequently, the average grain size of the ceramic grains in the electrically conductive line 2 becomes smaller in the inner side than in the surface portion close to the interface with the insulating base 1.

Also, in order to control the average grain size of the ceramic grains in the electrically conductive line 2 to be smaller than that of the electrically conductive grains in the electrically conductive line 2, an electrically conductive powder having a larger particle size may be used, or, for example, Cr may be used as the sintering agent. Cr can help the electrically conductive grains grow while hindering ceramic grains from growing in the electrically conductive line 2 in the step of sintering the electrically conductive line 2. Since the electrically conductive powder in the electrically conductive line 2 is sintered prior to the ceramic particles in the electrically conductive line 2, electrically conductive grains grow larger between ceramic grains in the electrically conductive line 2. Thus, the distance between the ceramic grains is increased, and consequently the ceramic grains are hindered from growing.

Subsequently, a compact (compact a) having a predetermined pattern of the electrically conductive paste that will be used as the resistor 3 is formed by injection molding or the like using the electrically conductive paste. Then, a compact (compact b) having a predetermined pattern of the electrically conductive paste that will be used as the leads 4 is formed by introducing the electrically conductive paste into the metallic mold with the compact a kept therein. Thus a state is established in which the compact a and the compact b joined to the compact a are held in the metallic mold.

Subsequently, after a part of the metallic mold, in which compact a and the compact b are held, is replaced with a mold for forming the insulating base 1, the ceramic paste for forming the insulating base 1 is introduced to the mold. Thus a compact (compact d) of the heater is prepared in which the compact a and the compact b are covered with the compact (compact c) of the ceramic paste.

Subsequently, the resulting compact d is sintered at a temperature of 1650° C. to 1780° C. and a pressure of 30 MPa to 50 MPa to yield the heater. The sintering is preferably performed in an atmosphere of hydrogen gas and a non-oxidizing gas.

EXAMPLES

Heaters of Examples of the present invention were prepared in a form as shown in FIG. 1 in a process as described below.

First, electrically conductive pastes were prepared, each containing 50% by mass of tungsten carbide (WC) powder for Sample No. 1 or 50% by mass of tungsten carbide (WC) to which Cr with a content of 1×10-3% by mass in terms of oxide had been added for Sample Nos. 2 and 3, 35% by mass of any of silicon nitride (Si3N4) powders having different particle size, and 15% by mass of a resin binder. Each electrically conductive paste was injected into a metallic mold to form compact a for a resistor.

Subsequently, the same electrically conductive paste was introduced for forming leads into the mold with the compact a kept therein, thus joining with the compact a. Thus a compact b was formed.

Subsequently, a ceramic paste containing 85% by mass of silicon nitride (Si3N4) powder, 10% by mass of ytterbium oxide (Yb2O3) as a sintering agent, and 5% by mass of tungsten carbide (WC) for bringing the thermal expansion coefficient close to that of the resistor and the leads was injected into the metallic mold with the compact a and compact b kept therein. Thus, a compact d was formed in which the compact a and the compacts b were embedded in a compact c for the insulating base.

Subsequently, the resulting compact d was sintered to yield a heater by hot press at a temperature of 1700° C. and a pressure of 35 MPa in an atmosphere of a non-oxidizing gas containing nitrogen gas in a carbon cylindrical mold. A cylindrical metallic holding member (metallic sheath) was welded to the end (terminal portion) of the lead exposed at the surface of the resulting sintered compact, and thus a glow plug was completed.

The insulating base in cross section had a circular periphery, and the resistor and the leads were oval in cross section. The insulating base had a diameter of 3.5 mm, and the resistor and leads had a longer axis of 1.3 mm and a shorter axis of 0.6 mm.

A pulse pattern generator was connected to the electrodes of the glow plug, and rectangular pulses with a pulse width of 10 μs were successively applied at an applied voltage of 7V at intervals of 1 μs. After 1000 hours elapsed, the variation between the resistances before and after power supply ((resistance after power supply —resistance before power supply)/resistance before power supply) was measured. The results are shown in Table 1.

TABLE 1

| Sample number | Sectional area of resistor ($mm^2$) | Sectional area of leads ($mm^2$) | Ceramic grain size in resistor | Electrically conductive grain size in resistor | Ceramic grain size in leads | Electrically conductive grain size in leads | Ceramic grain size in insulating base | Most heated portion | Variation in resistance (%) | Cracks between ceramic grains and electrically conductive grains in electrically conductive line |
|---|---|---|---|---|---|---|---|---|---|---|
| 1 | 0.60 | 0.60 | 1.3 μm | 1.8 μm | 1.3 μm | 1.8 μm | 1.2 μm | Contact of leads with resistor | 55 | Occurred |
| 2 | 0.60 | 0.60 | 0.9 μm | 2.1 μm | 0.9 μm | 2.1 μm | 1.2 μm | Heat-generating portion of resistor | 5 | Not observed |
| 3 | 0.60 | 0.60 | 0.8 μm | 1.2 μm | 0.8 μm | 1.2 μm | 1.2 μm | Heat-generating portion of resistor | 3 | Not observed |

In Sample No. 1, heat was most generated at the interface between the leads and the resistor, as shown in Table 1. For checking for power supply condition, the waveform of pulses flowing through the heater of Sample No. 1 was observed with an oscilloscope. Unlike input waveform, the leading edge of pulses was not sharp and it took 1 μs to reach 7 V, undulating and overshooting.

This is probably because, in the heater of Sample No. 1, the transmission of the high-frequency component in the leading edge of the pluses was disordered. Also, in the heater, heat was most generated at the boundaries between the leads and the resistor.

Furthermore, the variation between the resistances of Sample No. 1 before and after power supply was as very large as 55%. When the interfaces between the leads and resistor of Sample No. 1 were observed through a scanning electron microscope after pulses were supplied, micro-cracks were observed at interfaces between the ceramic grains and the electrically conductive grains in the surface portion of the electrically conductive line at the interface between the electrically conductive line and the insulating base. It was found that heat was locally generated at this position.

On the other hand, for Sample Nos. 2 and 3, heat was most generated at the heat-generating portion of the resistor at the tip of the heater. For checking for power supply condition, the waveform of pulses flowing through the heater was observed with an oscilloscope. The waveform was substantially the same as input waveform. This suggests that the heater was energized without straying high-frequency component or transmission disorder.

In Sample Nos. 2 and 3, the variation between the resistance before and after power supply was as small as 5% or less. When the interfaces between the leads and the resistor of these Samples were observed through a scanning electron microscope after pulses were supplied, micro-cracks were not observed.

Then, a DC power source was connected to the glow plug, and a heat cycle test was performed under the conditions where the voltage applied to the heater was set so that the temperature of the resistor could be increased to 1400° C., and a cyclic operation including: (1) supplying power for 5 minutes; and (2) suspending power supply for 2 minutes was repeated 10 thousand times. The variation between the resistance of the heater before and after power supply was measured.

Consequently, the variation between the resistance of Sample No. 1 before and after power supply was as very large as 55%. When the boundaries between the leads and the resistor were observed through a scanning electron microscope after power supply, micro-cracks were observed in interfaces between the ceramic grains and the electrically conductive grains in the surface portion of the electrically conductive line at the interface between the electrically conductive line and the insulating base. It was found that heat was locally generated at this position.

For Sample Nos. 2 and 3, on the other hand, the variation between the resistance before and after power supply is as small as 5% or less. When the boundaries between the leads and resistor of these samples were observed through a scanning electron microscope after DC power supply, micro-cracks were not observed.

REFERENCE SIGNS LIST

1: insulating base
2: electrically conductive line
3: resistor
31: heat-generating portion
4: lead
5: metallic holding member

What is claimed is:

1. A heater comprising an insulating base made of ceramic, and an electrically conductive line embedded in the insulating base, wherein the electrically conductive line contains electrically conductive grains and ceramic grains, the ceramic grains in the electrically conductive line have a smaller average grain size than the ceramic grains in the insulating base, and the ceramic grains in the electrically conductive line have a smaller average grain size in an inner side than in a surface portion close to the interface with the insulating base.

2. The heater according to claim 1, wherein the ceramic grains in the electrically conductive line have a smaller average grain size than the electrically conductive grains in the electrically conductive line.

3. The heater according to claim 1, wherein the electrically conductive line contains Cr with a content in the range of $1\times10^{-6}$% by mass to $1\times10^{-1}$% by mass in terms of oxide.

4. A glow plug comprising the heater as set forth in claim 1, and a metallic holding member electrically connected to the electrically conductive line and holding the heater.

* * * * *